US009352892B2

(12) United States Patent
Singh et al.

(10) Patent No.: US 9,352,892 B2
(45) Date of Patent: May 31, 2016

(54) SYSTEM, METHOD AND APPARATUS FOR MAKING AND USING FLEX COLUMN VOID BASED PACKING MATERIALS

(71) Applicant: CAL POLY CORPORATION, San Luis Obispo, CA (US)

(72) Inventors: Jay Singh, San Luis Obispo, CA (US); Evan Cernokus, San Luis Obispo, CA (US)

(73) Assignee: Cal Poly Corporation, San Luis Obispo, CA (US)

( * ) Notice: Subject to any disclaimer, the term of this patent is extended or adjusted under 35 U.S.C. 154(b) by 323 days.

(21) Appl. No.: 13/838,622

(22) Filed: Mar. 15, 2013

(65) Prior Publication Data

US 2014/0272412 A1 Sep. 18, 2014

(51) Int. Cl.

| | |
|---|---|
| ***B65D 81/00*** | (2006.01) |
| ***B65D 81/09*** | (2006.01) |
| ***B31D 5/04*** | (2006.01) |
| ***B31D 5/00*** | (2006.01) |

(52) U.S. Cl.

CPC ..... *B65D 81/09* (2013.01); *B31D 5/006* (2013.01); *B31D 5/04* (2013.01); *B31D 2205/0064* (2013.01); *Y10T 428/2975* (2015.01)

(58) Field of Classification Search

USPC ..... 206/584, 814; 428/98, 43, 131, 36.9

See application file for complete search history.

(56) References Cited

U.S. PATENT DOCUMENTS

| | | | | |
|---|---|---|---|---|
| 3,188,264 | A * | 6/1965 | Holden | B29C 67/2295 206/584 |
| 3,578,305 | A * | 5/1971 | Muelhauser | F16F 1/32 267/165 |
| 4,514,453 | A * | 4/1985 | Bussey, Jr. | B65D 81/09 206/523 |
| 4,931,333 | A * | 6/1990 | Henry | B65D 81/03 206/584 |
| 5,028,470 | A * | 7/1991 | Reichenecker | B65D 81/09 206/584 |
| 5,213,867 | A * | 5/1993 | Huston, Sr. | B31D 5/0073 206/584 |
| 5,568,867 | A * | 10/1996 | Lencoski | B65D 81/09 206/521 |
| 5,573,818 | A * | 11/1996 | Haywood | B32B 3/06 206/814 |
| 5,595,811 | A * | 1/1997 | Stout, Jr. | B65D 81/09 206/521 |
| 5,643,647 | A * | 7/1997 | Wischusen, III | B65D 81/09 206/584 |
| 5,882,767 | A * | 3/1999 | Simmons, Jr. | B31D 5/0047 206/449 |
| 5,947,293 | A * | 9/1999 | Burchard | B29C 44/5654 206/523 |
| 6,835,437 | B2 | 12/2004 | Goers et al. | |

OTHER PUBLICATIONS

Website: http://expandos.com/our-products—Our Products—ExpandOS VF—"Minimal protection void fill alternative", ExpandOS MD—"Versatile protection for most shipping situations", ExpandOS HD—"Protective packaging for very heavy items"; (1) page.

* cited by examiner

*Primary Examiner* — Jacob K Ackun

(74) *Attorney, Agent, or Firm* — Martine Penilla Group, LLP

(57) ABSTRACT

A system, method and apparatus for forming a flex-column includes a three-sided column having a triangular cross-sectional shape, an open first end, an open second end, and three corners, each one of the three sides including a flex line dividing each of the three sides into two portions, at least one perforation along an edge of each one of the two portions wherein the edge of each one of the two portions coincides with one of the three corners and at least one non-perforation along an edge of each one of the two portions.

20 Claims, 12 Drawing Sheets

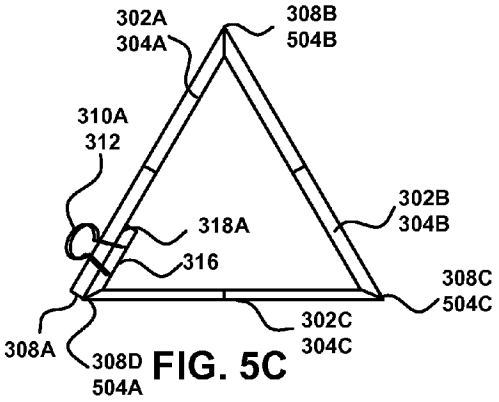
FIG. 5C
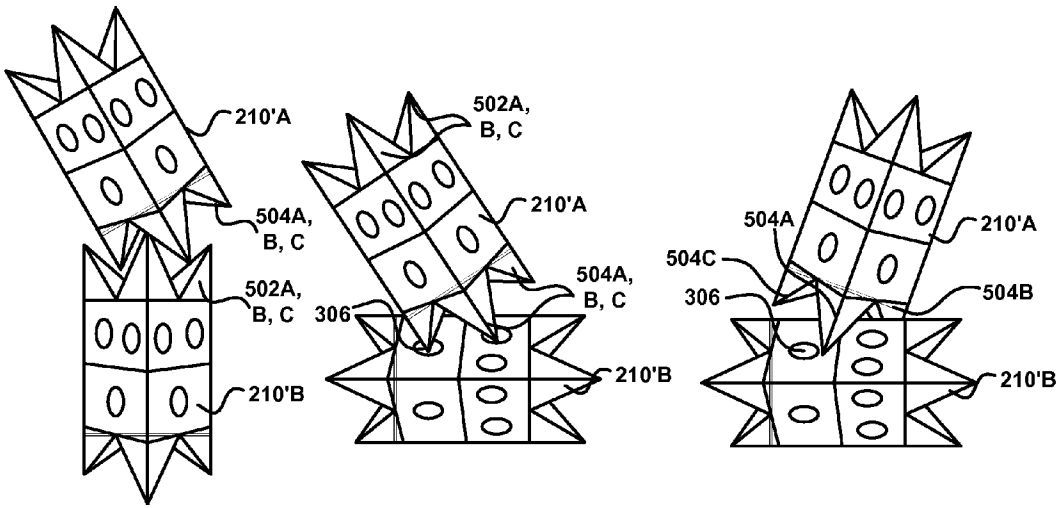
FIG. 5D
FIG. 5E
FIG. 5F

SYSTEM, METHOD AND APPARATUS FOR MAKING AND USING FLEX COLUMN VOID BASED PACKING MATERIALS

BACKGROUND

The present invention relates generally to packing materials, and more particularly, to systems and methods for forming space consuming, shock absorbing packing materials.

Typical void or space consuming packaging is used to fill space in a packing container around the product being supported and shipped in the container. FIG. 1 illustrates a typical void packing material 112, 112' in a container 110. The typical void packing material 112 is a polystyrene shape often referred to as "peanut" shapes or "popcorn" shapes. There are many different shapes and sizes of the polystyrene void packing material 112. A first quantity of the polystyrene void packing material 112' is placed in the container 110 (e.g., shipping box). A product 120 is then placed on top of the first quantity of the polystyrene void packing material 112'. A second quantity of the polystyrene void packing material 112 (not shown for clarity purposes) is added to the container 110 around the sides 120A-D of the product 120. A third quantity of the polystyrene void packing material 112 (not shown for clarity purposes) is added to the container 110 and between the top 120E of the product 120 and a top 110A of the container.

The container 110 can then be closed. The polystyrene void packing material 112, 112' surrounds, supports and separates all sides, top and bottom of the product 120 from the respective sides, top and bottom of the container 110. As a result the polystyrene void packing material 112, 112' protects the product 120 from shocks from impacts during shipment, partial crushing of the container 110 and relatively minor intrusions (e.g., punctures, tears, cuts, etc.) into the container 110.

However, the polystyrene void packing material 112, 112', like most void packing materials has a fixed volume that also consumes large space such as during a bulk shipment of packing material to a user's shipping facility where it will be used. This large space requirement increases the cost of shipment and delivery to the user. This large space requirement also requires the user to provide a correspondingly large storage space for storing the large volume of the void packing materials until used, further increasing the costs of most void packing materials.

Further, most void packing materials are made from virgin materials and are typically used once and disposed of. In the instance of polystyrene void packing material 112, 112' the disposed of polystyrene will end up in a dump where it will decompose over the course of many years and even decades. As the polystyrene decomposes toxic and other undesirable chemicals can be produced that can contaminate ground water and air. This use once and disposal cycle of most void packing materials further increases the cost of the void packing materials to the user and to the society at large.

In view of the foregoing, there is a need for a void packing material that is compact in volume during pre-use shipment and storage and is inexpensive and preferably easily recyclable and reusable and/or can be made from a post consumer waste product.

SUMMARY

Broadly speaking, the present invention fills these needs by providing a flex-column void packing material. It should be appreciated that the present invention can be implemented in numerous ways, including as a process, an apparatus, a system, computer readable media, or a device. Several inventive embodiments of the present invention are described below.

One embodiment provides a flex-column including a three-sided column having a triangular cross-sectional shape, an open first end, an open second end, and three corners, each one of the three sides including a flex line dividing each of the three sides into two portions, at least one perforation along an edge of each one of the two portions wherein the edge of each one of the two portions coincides with one of the three corners and at least one non-perforation along an edge of each one of the two portions.

Another embodiment provides a method of making a void packing material including determining a two-dimensional pattern for a desired three-dimensional shaped flex-column, forming the two-dimensional pattern on a selected sheet of material having a selected thickness, separating the two-dimensional pattern from the selected sheet, folding the two-dimensional pattern along fold lines to form the three-dimensional shaped flex-column, and securing the three-dimensional shaped flex-column.

Yet another embodiment provides a flex-column including a three-sided column having a triangular cross-sectional shape, an open first end, an open second end, and three corners, each one of the three sides including a flex line dividing each of the three sides into two portions, at least one perforation along an edge of each one of the two portions wherein the edge of each one of the two portions coincides with one of the three corners and at least one non-perforation along an edge of each one of the two portions, wherein the at least one non-perforation along an edge of each one of the two portions coincides with an intersection of the flex line and at least one of the three corners, wherein each one of the three sides has a thickness corresponding to a desired flex characteristic, wherein the at least one non-perforated portion along an edge of each one of the two portions has a length corresponding to a desired flex characteristic, wherein the at least one perforated portion along an edge of each one of the two portions has a length corresponding to a desired flex characteristic.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings.

FIG. 5C is an end view of the flex-column, in accordance with embodiments of the present invention.

FIGS. 5D-5F illustrate interlocking flex-columns, in various interlocking orientations, in accordance with embodiments of the present invention.

DETAILED DESCRIPTION

Figure 1:
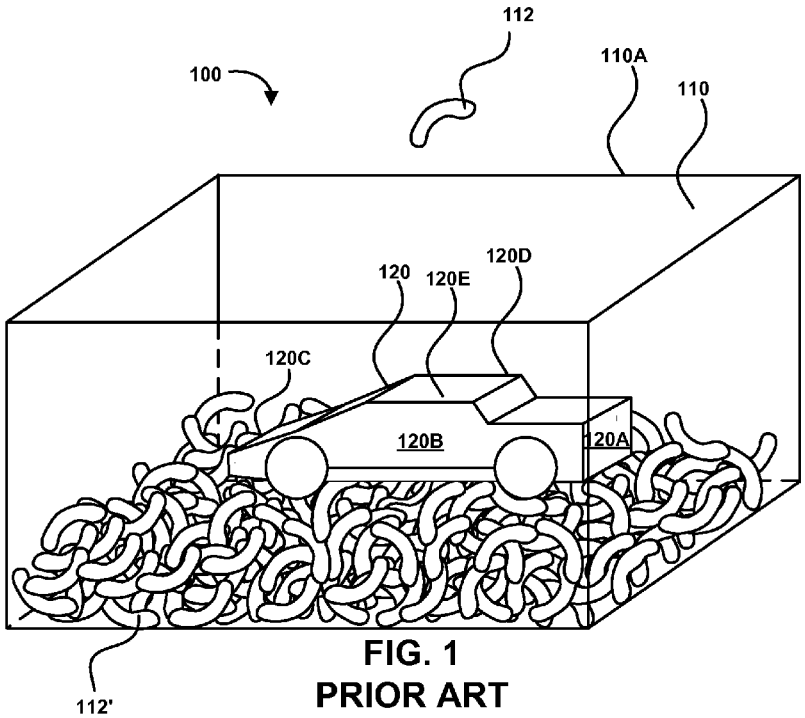
FIG. 1 PRIOR ART
FIG. 1 illustrates a typical void packing material in a container.

Several exemplary embodiments for a flex-column void packing material will now be described. It will be apparent to those skilled in the art that the present invention may be practiced without some or all of the specific details set forth herein.

A flex-column void packing material is a space saving expandable loose fill packaging and cushioning material. Flex-columns can be formed from paperboard made from post industrial or consumer waste paper and cardboard. The flex-column void packing material can be shipped a user customer in the form of a compact, pre-cut, pre-perforated sheets. The pre-cut, pre-perforated sheets are fed through a forming machine. The forming machine separates the flex-columns from the pre-cut sheets and folds the separated flex-columns into a corresponding three-dimensional shape.

Shipping containers can be filled with flex-columns and the product to be protected. The unique shapes of the flex-columns allows the flex-columns to interlock and prevent the product from settling to the bottom of the shipping container, where the product is more susceptible to damage and shock from mishandling.

The flex-column design allows the void fill material to flex to absorb the impact shocks and other forces sustained during shipment and handling of the shipping container. This flexing ability cushions the product further preventing damage from shock. The flex-column reduces costs created from shipping, storing, and product damage.

The flex-column can be easily customized as needed by a given product. By way of example, the thickness of the pre-cut, pre-perforated sheets can be varied according to the desired strength of the flex-columns. The number and placement of various cuts and perforations in the flex-column can also be varied according to the desired strength and shock absorbing characteristics of the flex-columns. The size, shape and relative proportions of length and width of the flex-column can be varied according to the desired strength of the flex-columns.

The flex-column design includes of a series of panels that fold into a flexible, column with a triangular-shaped cross-section. In one embodiment, the flex-column design includes 14 triangular panels and 8 rectangular panels. The flex-column design does not require crease lines, rather perforations are used to assist in the folding of the flat, two-dimensional sheet into the three-dimensional flex column.

In one exemplary construction the flex-column is formed from paperboard having a basis weight of approximately 65-75 lbs and a thickness ranging from about 0.015 inches to about 0.024 inches, depending on need. The paperboard sheet can be die cut. The flex-column design can be arranged on the paperboard sheet to minimize or even eliminate waste paperboard. Once formed, the flex-column has 12 faces and 15 folds. The edges of the flex-column have a wave or tooth contour to encourage interlocking between individual flex-column Six faces of the flex-column have holes in order to decrease weight and increase opportunities for interlocking between individual flex-columns. The flex-column is held in the folded, three-dimensional form by two tabs and two corresponding slits and/or an adhesive.

Figure 2:
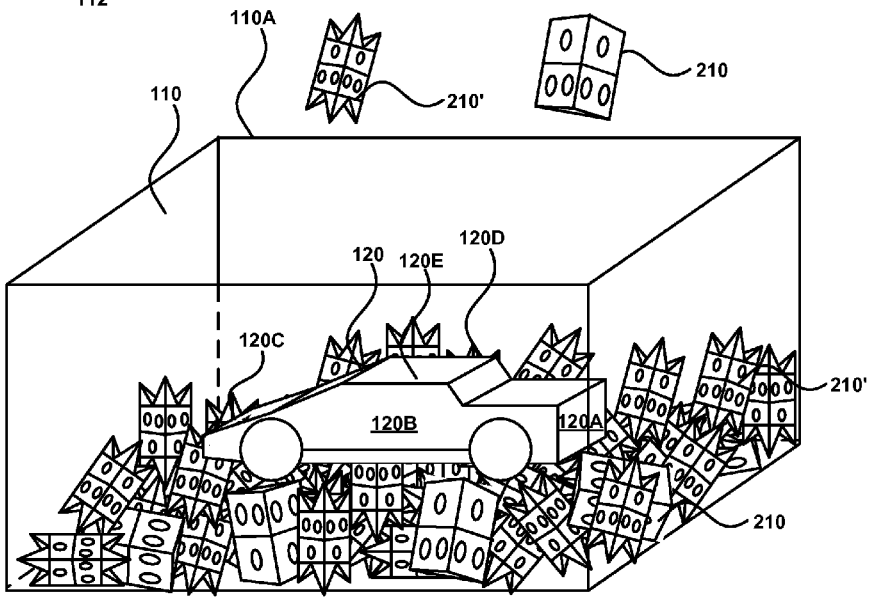
FIG. 2 illustrates flex-column, void packing material in a container, in accordance with embodiments of the present invention.

FIG. 2 illustrates flex-column, void packing material 210, 210' in a container 110, in accordance with embodiments of the present invention. There are many different shapes and sizes of the flex-column, void packing material 210, 210', the shapes and sizes shown are merely exemplary and not intended to be limited to only the shown shapes and sizes. A first quantity of the flex-columns 210, 210' is selected to have support characteristics as may be required by the product, the shipping container, and the foreseeable handling challenges during shipment. The first quantity of the flex-columns 210, 210' is placed in the container 110 (e.g., shipping box). A product 120 is then placed on top of the first quantity of the flex-columns 210, 210'. A second quantity of the flex-columns 210, 210' (not shown for clarity purposes) is added to the container 110 around the sides 120A-D of the product 120. A third quantity of the flex-columns 210, 210' (not shown for clarity purposes) is added to the container 110 and between the top 120E of the product 120 and a top 110A of the container.

Figure 3A:
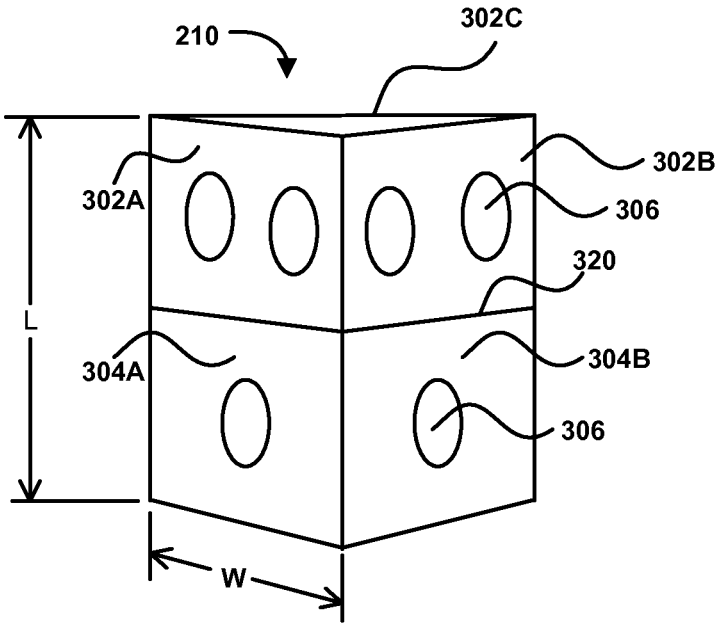
FIG. 3A is a perspective side view of a flex column, in accordance with embodiments of the present invention.
Figure 3B:
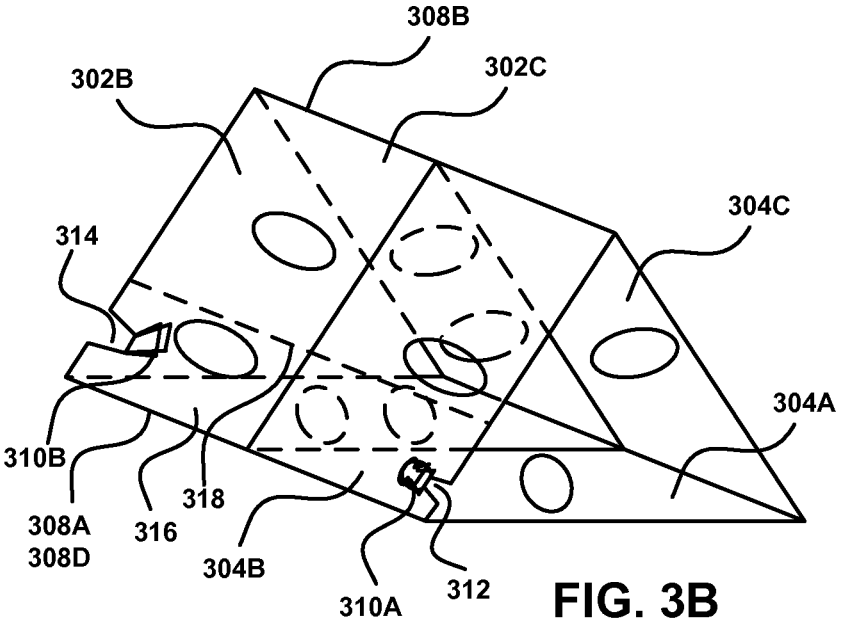
FIG. 3B is a perspective end view of a flex column, in accordance with embodiments of the present invention.
Figure 3C:
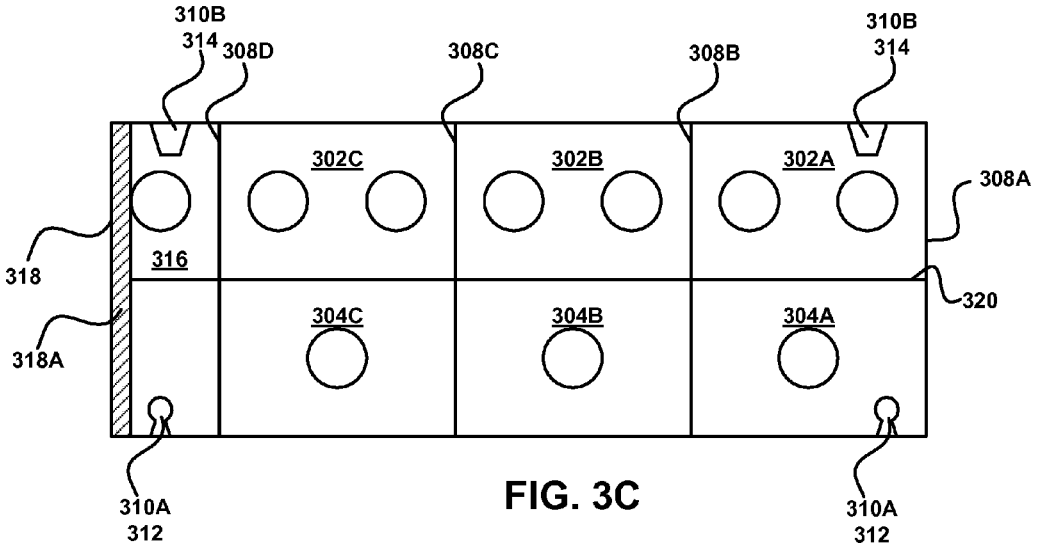
FIG. 3C illustrates the flex-column in two-dimensional form before folding, in accordance with embodiments of the present invention.
Figure 3D:
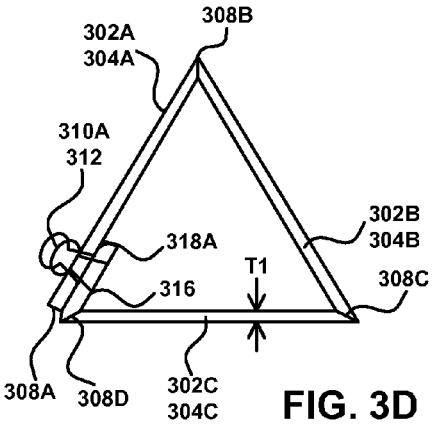
FIG. 3D is an end view of the flex-column, in accordance with embodiments of the present invention.

FIG. 3A is a perspective side view of a flex column 210, in accordance with embodiments of the present invention. FIG. 3B is a perspective end view of a flex column 210, in accordance with embodiments of the present invention. FIG. 3C illustrates the flex-column 210 in two-dimensional form before folding, in accordance with embodiments of the present invention. FIG. 3D is an end view of the flex-column 210, in accordance with embodiments of the present invention.

The flex column 210 has a triangular cross-sectional shape formed by three sides 302A-C/304A-C. Each of the sides 302A-C/304A-C has a selected thickness T1. Each of the sides 302A-C/304A-C is divided by a flex line 320 into two portions 302A-C and 304A-C. The sides 302A-C/304A-C are coupled to the adjacent side by respective folded corners 308A-D. Tab 318 extends from side 302A/304A and overlaps a portion of side 302C/304C. The tab 318 can be secured to the inside surface or the external surface of side 302C/304C by tabs 312, 314 and slits 310A-B or adhesive 318A or both or any other suitable means. The tabs 312, 314 and slits 310A-B can be in any suitable, interlocking shapes and sizes. The shapes and sizes of the tabs 312, 314 and slits 310A-B are merely exemplary.

As will be described in more detail below, each of the folds 308A-D and flex lines 320 are formed along precisely shaped, sized and placed perforations. The shape, size and location of the perforations in each of the folds 308A-D and flex lines 320 assists in providing a selected amount of flex in the lengthwise direction of the flex-column 210. The selected amount of flex in the lengthwise direction of the flex-column 210 is referred to as the flex characteristics of the flex-column. The selectable flex characteristics allows the flex-column 210 to be tuned to allow a selected amount of flex and response for minor shock absorption and to allow a selected activation in response to a selected larger magnitude shocks and impacts.

The sides 302A-C/304A-C include multiple holes 306 to reduce weight and provide additional opportunity for the flex-columns 210 to interlock. By way of example, the three corners on each end of the flex-columns 210 can interlock in a hole 306 or an open end of another flex-column.

Figure 3E:
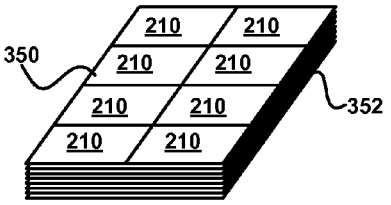
FIG. 3E illustrates a stack of multiple precut sheets of the flex-columns, in accordance with embodiments of the present invention.

FIG. 3E illustrates a stack 350 of multiple precut sheets of the flex-columns 210, in accordance with embodiments of the present invention. Each precut sheet includes multiple flex-columns 210. The stack 350 of multiple precut sheets of the flex-columns 210 minimizes volume and space requirements for shipping and storage prior to use.

Figure 4:
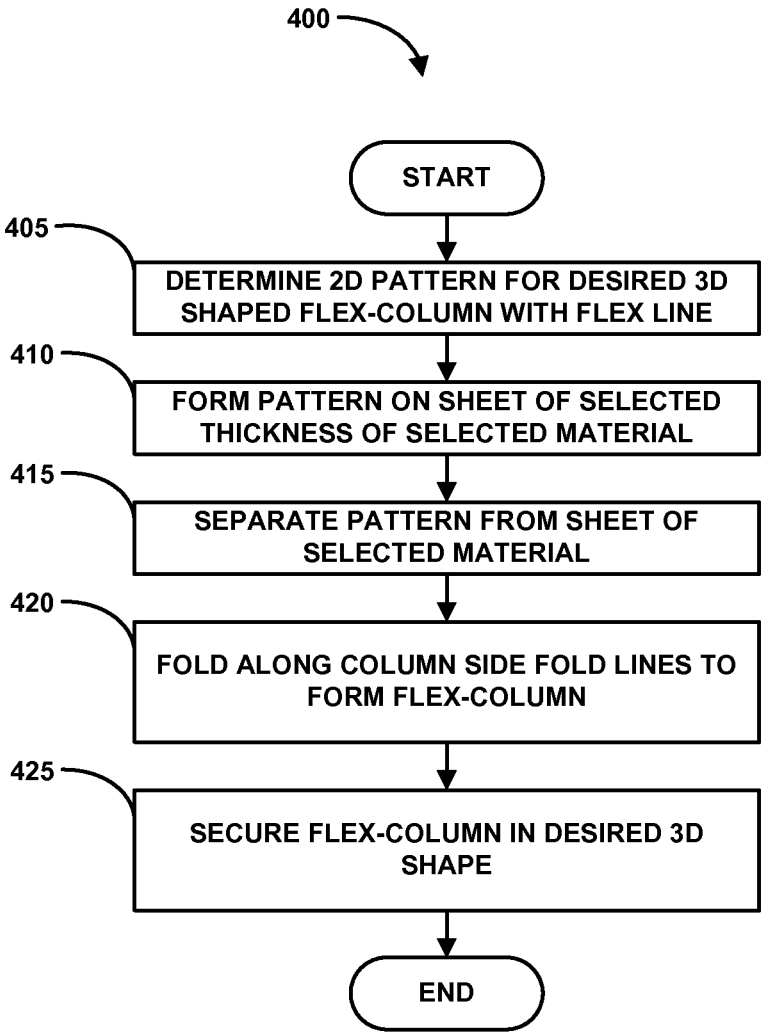
FIG. 4 is a flowchart diagram that illustrates the method operations performed in forming a flex-column, in accordance with one embodiment of the present invention.

FIG. 4 is a flowchart diagram that illustrates the method operations performed in forming a flex-column 210, in accordance with one embodiment of the present invention. In an operation 405, a two-dimensional pattern of the flex-column 210 having the desired flex characteristics is determined. The desired flex characteristics are a determined by a combination of the material type, material thickness T1, flex-column length L, flex-column width W and the shape, size and location of the perforations that define the folds 308A-D and flex lines 320.

In an operation 410, the selected two-dimensional pattern of the flex-column 210 is formed on a selected sheet of material. As discussed above, the sheet material can be any suitable type of material and combination of materials. By way of example, in a very light weight, delicate, use, the sheet material may be a sheet of paper such as a 20 pound bond weight of paper. Conversely, in a relatively heavy weight, rough use, the sheet material may be a relatively thick paperboard having a thickness T1 of between about 0.05 inches and about 0.25 inches. It should be understood that a corrugated type of cardboard or a plastic material or any other suitable material may be used.

In an operation 415, the two-dimensional pattern of the flex-column 210 is separated from the sheet of material and the two-dimensional pattern can be folded into the corresponding three-dimensional shape in an operation 420. In an operation 425, the tab 318 is secured to the side 302C/304C using tabs 312, 314 and slits 310A-B or adhesive 318A or both or any other suitable means. Operations 415-425 can be performed in an automated separation and folding machine.

Prior to operations 415-425, the flex-columns 210 were in a flat, two-dimensional form and thus consumed minimal volume such as may be desired for pre-use shipping and storage. It should be understood that operations 405 and 410 can be performed at a manufacturing site for the flex-columns 210 and then the sheets of two-dimensional patterns of flex-columns 210 can be shipped to a user's location. Operations 415-425 can be performed immediately prior to use as void filling packing material, thus minimizing the pre-use storage space required by the flex-columns 210 at the user's facility.

Figure 5A:
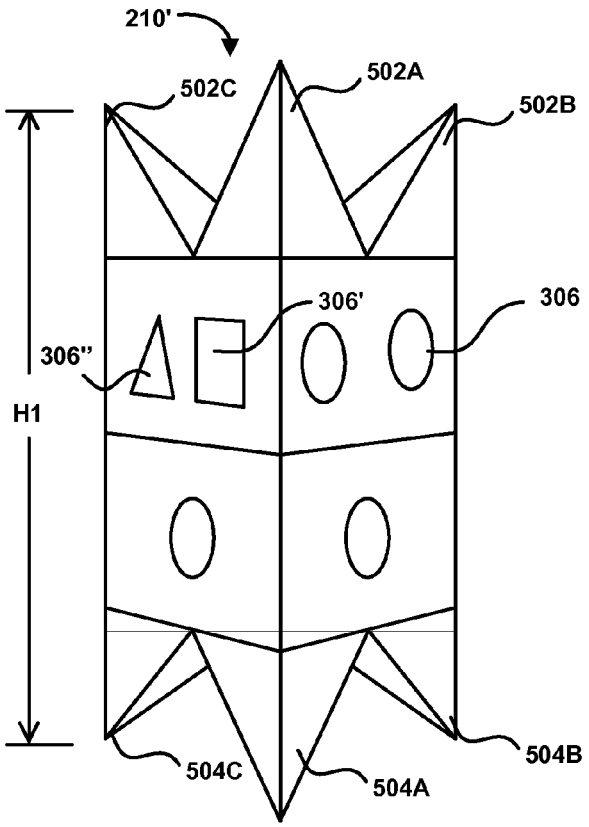
FIG. 5A is a perspective side view of a flex column, in accordance with embodiments of the present invention.
Figure 5B:
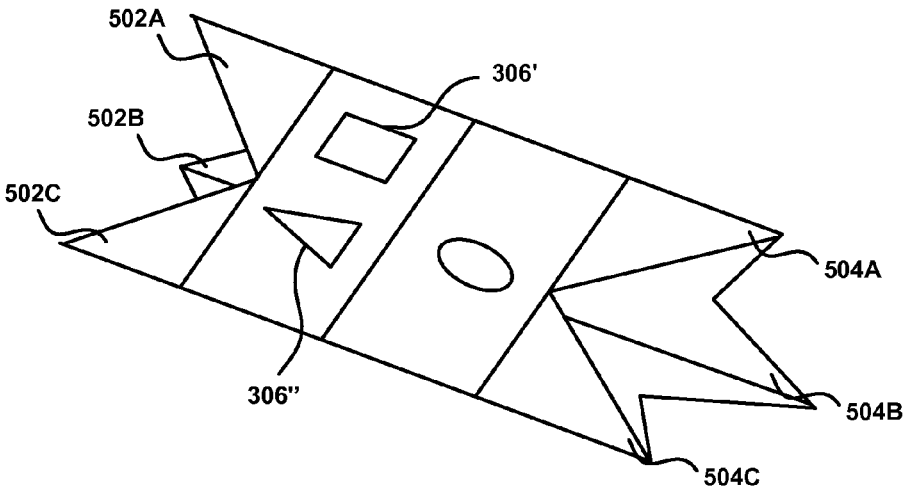
FIG. 5B is a perspective end view of a flex column, in accordance with embodiments of the present invention.

FIG. 5A is a perspective side view of a flex column 210', in accordance with embodiments of the present invention. FIG. 5B is a perspective end view of a flex column 210', in accordance with embodiments of the present invention. FIG. 5C is an end view of the flex-column 210', in accordance with embodiments of the present invention.

Flex-column 210' is substantially similar in size and construction as the flex-column 210, described above. However, flex-column 210' has additional features as compared to the flex-column 210. Flex-column 210' includes different shaped and sized holes 306', 306" in the sides. The illustrated shapes circle/ellipsoid 306, rectangular/trapezoidal 306', triangular 306" and locations are merely exemplary and any suitable shapes and locations and arrangements can be used.

The flex-column 210' also includes points 502A-C and 504A-C at the respective ends and corners of the flex-column. FIGS. 5D-5F illustrate interlocking flex-columns 210'A, 210'B, in various interlocking orientations, in accordance with embodiments of the present invention. The points 502A-C and 504A-C and the holes 306, 306', 306" provide additional locations for the flex-columns 210'A, 210'B, 210' 210 to interlock. The points 502A-C and 504A-C of a first flex-column 210'A can also interlock with a corner fold on one side of a second flex-column 210'B as shown in FIG. 5F.

Figure 6B:
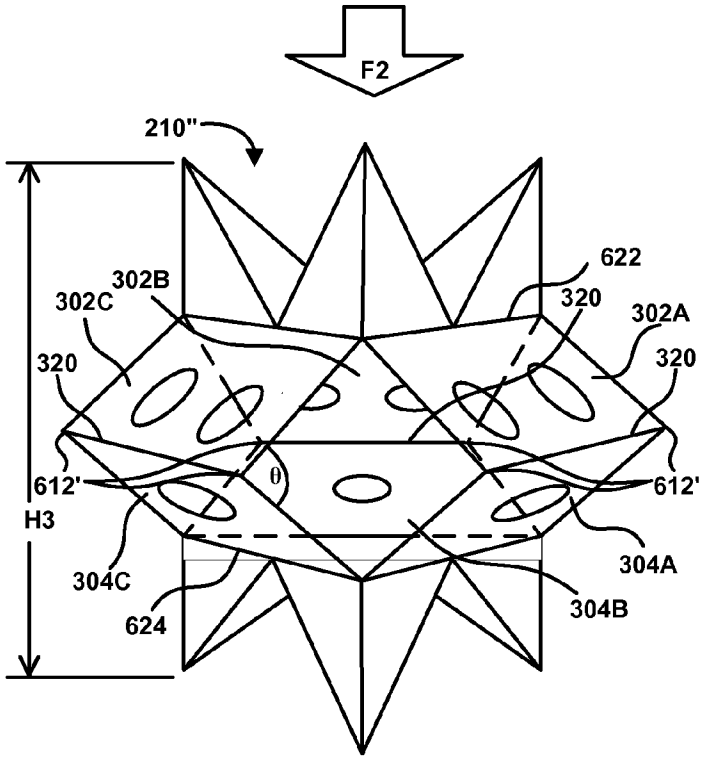
FIG. 6B illustrates a flex-column flexing lengthwise to absorb a second force, in accordance with embodiments of the present invention.
Figure 6A:
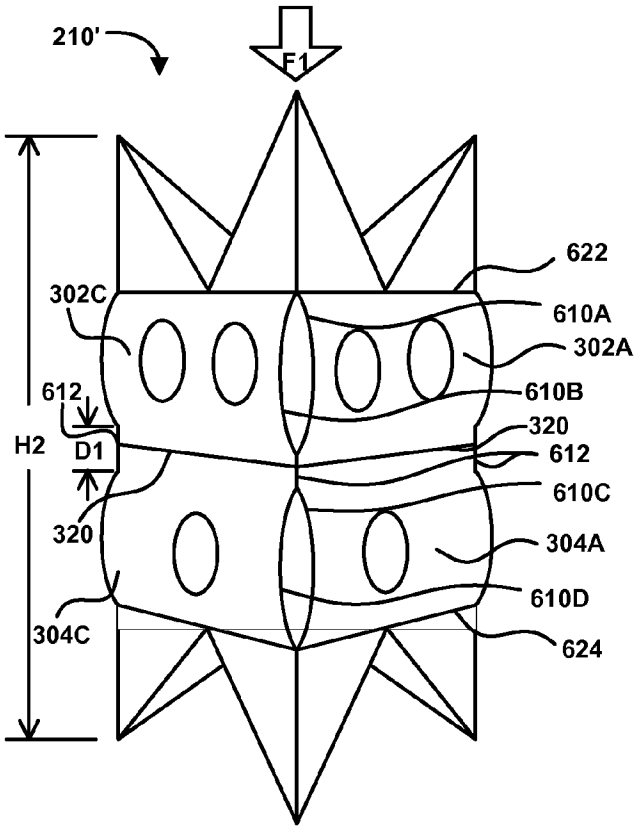
FIG. 6A illustrates a flex-column flexing lengthwise to absorb a first force, in accordance with embodiments of the present invention.

FIG. 6A illustrates a flex-column 210' flexing lengthwise to absorb a first force F1, in accordance with embodiments of the present invention. The first force F1 is sufficient to compress the flex-column 210' from an unloaded height H1 (shown in FIG. 5A) to a reduced height of F1 loaded height H2. The first force F1 causes edges 610A, 610B of side panels 302A-C to bow outward. The first force F1 also causes edges 610C, 610D of side panels 304A-C to bow outward. The length of perforations separating edges 610A, 610B and separating edges 610C, 610D partially determine the lengthwise flexibility characteristics of the flex-column 210'. The attached portions 612 help provide a lengthwise resilience of the flex-column 210'. The resilience of the flex-column 210' corresponds to a width D1 of the attached portions 612, as will be described in more detail below.

FIG. 6B illustrates a flex-column 210" flexing lengthwise to absorb a second force F2, in accordance with embodiments of the present invention. The second force F2 is greater than the first force F1. The second force F2 is sufficient to compress the flex-column 210" from a F1 loaded height H2 (shown in FIG. 6A) to a further reduced height of F2 loaded height H3. The second force F2 causes edges 610A, 610B and edges 610C, 610D to bow outward with sufficient force to tear the attached portions 612. When the attached portions 612 are torn, this is referred to activating the flex-column 210". Thus allowing the side panels 302A-C, 304A-C to flex or fold along the flex line 320 to form first fold angle θ. The flex line 320 is formed by precisely shaped, sized and located perforations that correspond to a desired resistance to folding or flexing along the flex line 320.

Figure 6D:
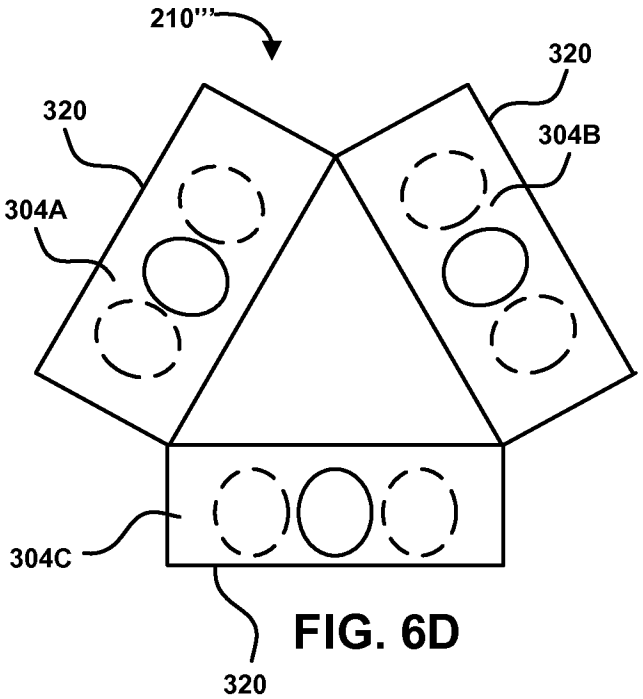
FIG. 6D is an end view of flex-column flexing lengthwise to absorb a third force, in accordance with embodiments of the present invention.
Figure 6C:
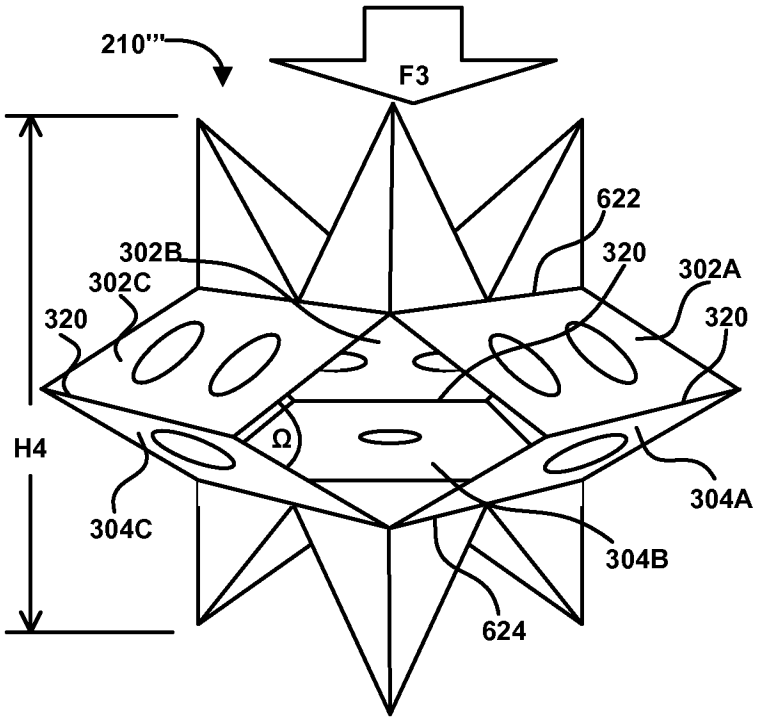
FIG. 6C illustrates a flex-column flexing lengthwise to absorb a third force, in accordance with embodiments of the present invention.

FIG. 6C illustrates a flex-column 210'" flexing lengthwise to absorb a third force F3, in accordance with embodiments of the present invention. FIG. 6D is an end view of flex-column 210'" flexing lengthwise to absorb a third force F3, in accordance with embodiments of the present invention. The third force F3 is greater than the second force F2. The third force F3 is sufficient to compress the flex-column 210'" from a F2 loaded height H3 (shown in FIG. 6B) to a further reduced height of F3 loaded height H4. The third force F3 causes the side panels 302A-C, 304A-C to further flex or fold along the flex line 320 to form second fold angle Ω, where second fold angle Ω is more acute than first fold angle θ. The flex line 320 is formed by precisely shaped, sized and located perforations that correspond to a desired resistance to folding or flexing along the flex line 320.

Figure 7:
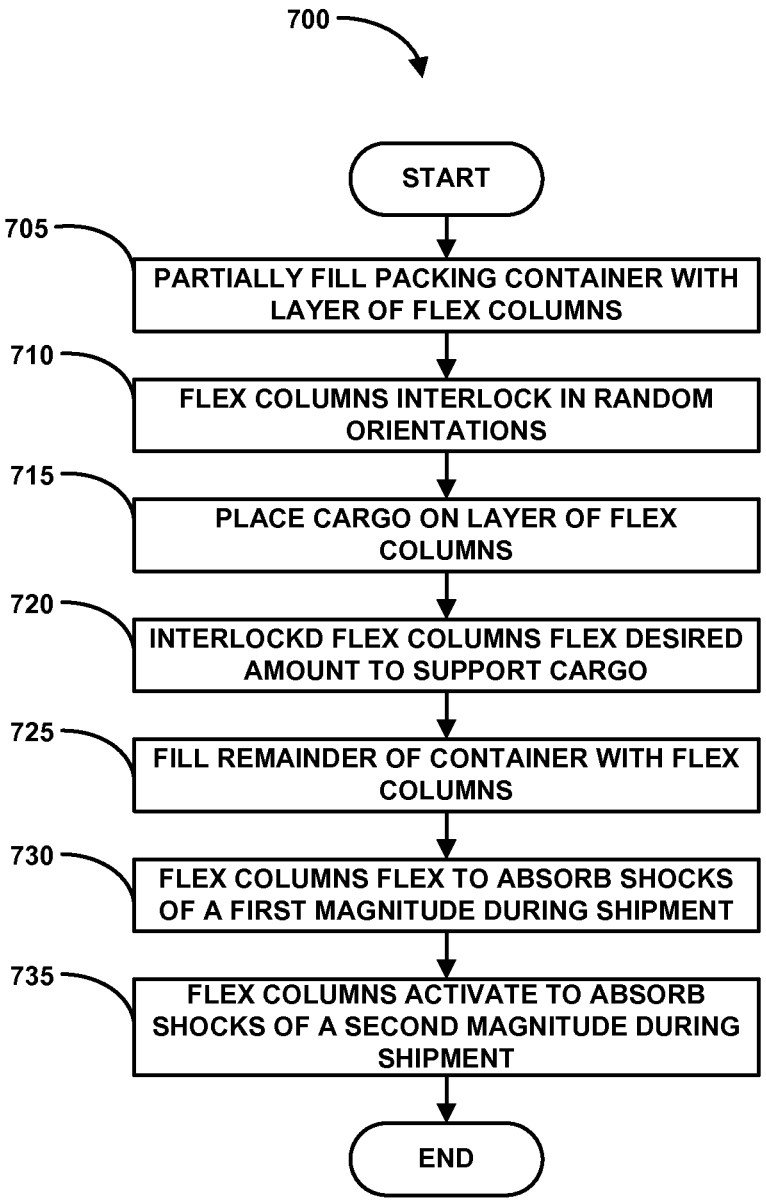
FIG. 7 is a flowchart diagram that illustrates the method operations performed in using a flex-column, in accordance with one embodiment of the present invention.

FIG. 7 is a flowchart diagram that illustrates the method operations performed in using a flex-column 210, 210', in accordance with one embodiment of the present invention. In an operation 705, a packing container is partially filled with multiple flex-columns 210, 210'. The flex-columns 210, 210' can be the same shape and size with the same flex characteristics. Alternatively, the flex-columns 210, 210' can have multiple different shapes and sizes with multiple different flex characteristics. The flex-columns 210, 210' interlock is a variety of substantially random orientations, in an operation 710.

In an operation 715, a cargo/product is placed on the multiple flex-columns 210, 210' in the partially filled packing container. The substantially randomly interlocked flex-columns 210, 210' flex a selected amount, determined by the design of the flex-columns to support the weight of the cargo/product, in an operation 720.

In an operation 725, the remainder of the packing container is filled with additional multiple flex-columns 210, 210' and the packing container can be closed. In an operation 730, the multiple flex-columns 210, 210' absorb shocks and impacts of a force F1 during shipment. In an operation 735, the at least a portion of the multiple flex-columns 210, 210' activate to absorb a force F2 or F3 during shipment.

Figure 8A:
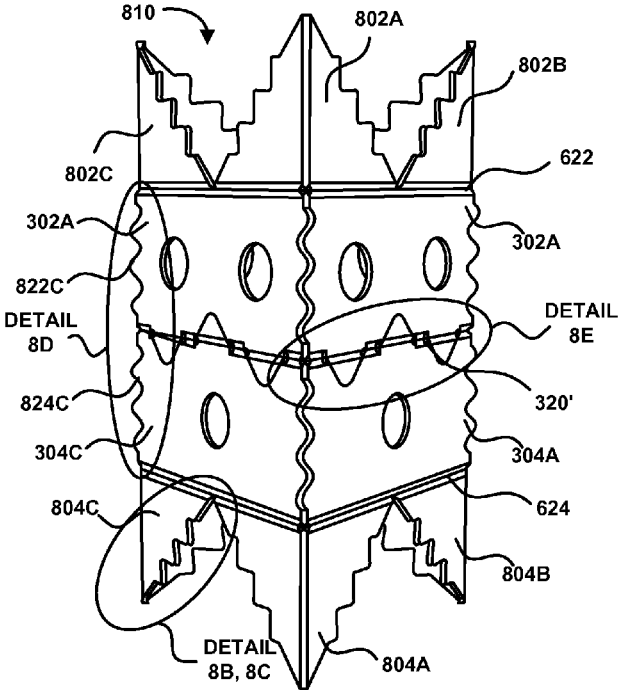
FIG. 8A is a perspective side view of a flex column, in accordance with embodiments of the present invention.
Figure 8B:
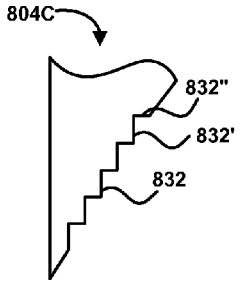
FIGS. 8B-E are a detailed views 8B-8D of corresponding portions of the flex column, in accordance with embodiments of the present invention.
Figure 8C:
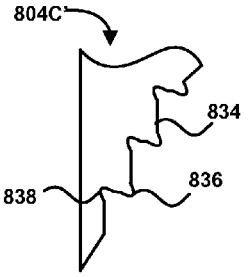

FIG. 8A is a perspective side view of a flex column 810, in accordance with embodiments of the present invention. FIGS. 8B-E are a detailed views 8B-8D of corresponding portions of the flex column 810, in accordance with embodiments of the present invention.

Flex-column 810 is substantially similar in size and construction as the flex-column 210', described above. However, flex-column 810 has additional features as compared to the flex-column 210'. Flex-column 810 includes different shaped edges and fold lines to increase the opportunity for the interlocking of multiple flex-columns 810. As shown in detailed views 8B and 8C, the edges of the points 802A-C, 804A-C are irregular instead of straight as described above. The edges of the points 802A-C, 804A-C can be stair stepped 832, 832', 832" or saw-toothed 834, 836, 838 as shown in detailed views 8B and 8C respectively. The sizes of each and number of the stair steps or saw teeth can be the same or vary as may be desired.

Figure 8D:
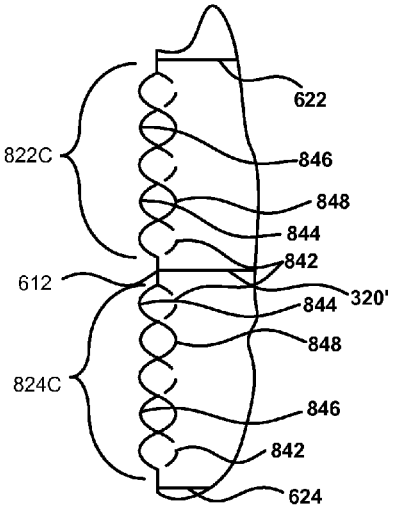

FIG. 8D shows a detailed view of the edges 822C and 824C of the respective sides 302C, 304C. The edges 822C and 824C include multiple scallops 842, 846, 848. When folded, the edges 822C and 824C cause the multiple scallops 842, 846, 848 to protrude and thus provide an edge that can interlock on another edge of another flex-column 810.

Figure 8E:
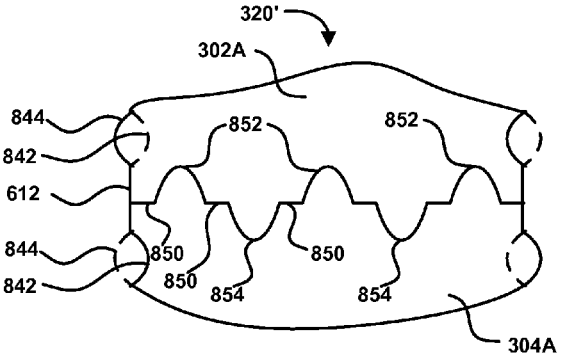

FIG. 8E shows a detailed view of the fold line 320' of the respective sides 302A, 304A. The fold line 320' is formed from multiple curved perforations 852, 854. The curved perforations 852, 854 are separated by non-perforated portions 850. The height and width of each of the curved perforations 852, 854, the number of curved perforations and the width of the non-perforated portions 850 determine how easily (i.e., small force) or how difficult (i.e., larger force) the fold line 320' resists folding.

Figure 9A:
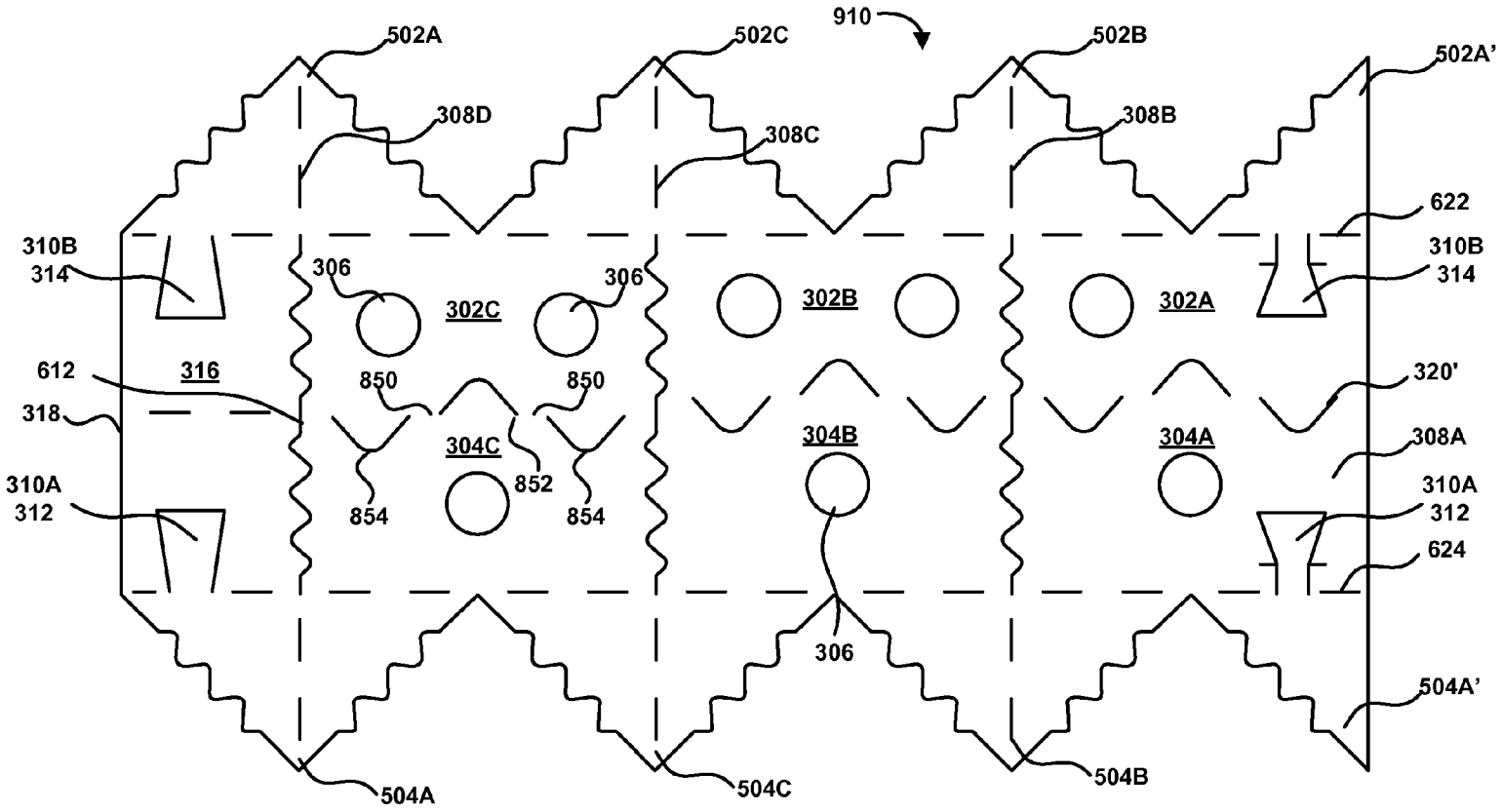
FIG. 9A is a two-dimensional pattern of the flex-column, in accordance with embodiments of the present invention.
Figure 9B:
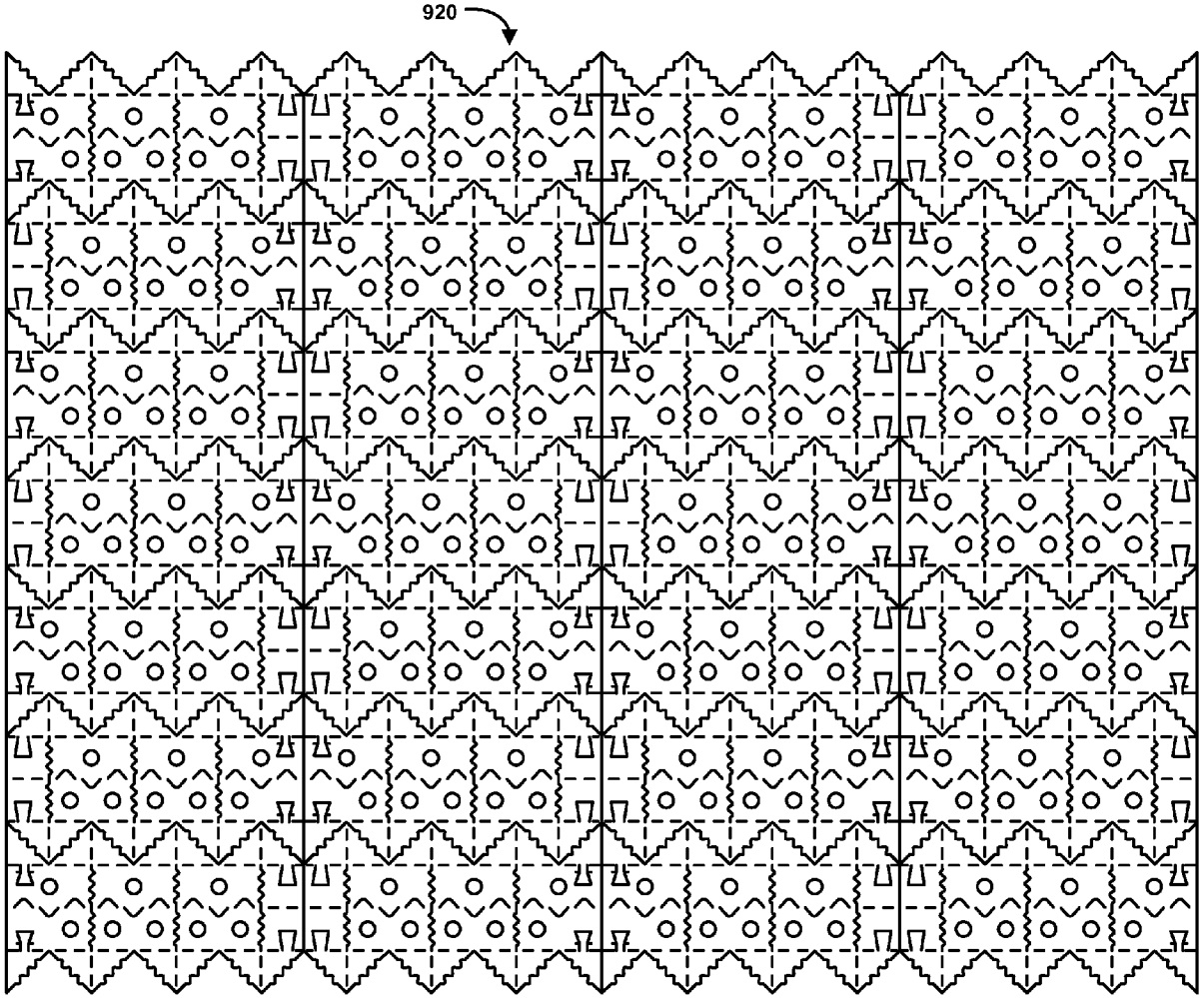
FIG. 9B is pre-cut sheet of multiple flex-columns, in accordance with embodiments of the present invention.

FIG. 9A is a two-dimensional pattern 910 of the flex-column 810, in accordance with embodiments of the present invention. FIG. 9B is pre-cut sheet of multiple flex-columns 810, in accordance with embodiments of the present invention. The benefit of symmetrically shaped edges is illustrated in FIG. 9B as very little of the sheet 920 is wasted material, even though the flex-column 810 is a much greater detailed design as compared to flex-column 210.

It will be further appreciated that the instructions represented by the operations in the above figures are not required to be performed in the order illustrated, and that all the processing represented by the operations may not be necessary to practice the invention.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A flex-column comprising:

a three-sided column having a triangular cross-sectional shape, an open first end, an open second end, and three corners, each one of the three sides including:

a flex line dividing each of the three sides into two portions; the flex line allowing the two portions to flex along the flex line to form first fold angle between the two portions;

at least one perforation along an edge of each one of the two portions wherein the edge of each one of the two portions coincides with one of the three corners; and at least one non-perforation along an edge of each one of the two portions.

2. The flex-column of claim 1, further comprising at least one hole formed in at least one of the two portions of each side.

3. The flex-column of claim 1, wherein the flex line is disposed substantially equally distant from the first open end and the second open end.

4. The flex-column of claim 1, wherein the at least one non-perforation along an edge of each one of the two portions coincides with an intersection of the flex line and at least one of the three corners.

5. The flex-column of claim 1, wherein a first one of the three sides is coupled to a third side.

6. The flex-column of claim 1, wherein a first one of the three sides is coupled to a third side by at least one of a tab, a slit and an adhesive.

7. The flex-column of claim 1, wherein each one of the three sides has a thickness corresponding to a desired flex characteristic defining a selected amount of flex in the lengthwise direction of the flex-column.

8. The flex-column of claim 1, wherein the at least one non-perforated portion along an edge of each one of the two portions has a length corresponding to a desired flex characteristic defining a selected amount of flex in the lengthwise direction of the flex-column.

9. The flex-column of claim 1, wherein the at least one perforated portion along an edge of each one of the two portions has a length corresponding to a desired flex characteristic defining a selected amount of flex in the lengthwise direction of the flex-column.

10. The flex-column of claim 1, wherein the flex line includes at least one perforated portion and at least one non-perforated portion.

11. The flex-column of claim 10, wherein the at least one perforated portion and has a length corresponding to a desired flex characteristic defining a selected amount of flex in the lengthwise direction of the flex-column.

12. The flex-column of claim 10, wherein the at least one non-perforated portion and has a length corresponding to a desired flex characteristic defining a selected amount of flex in the lengthwise direction of the flex-column.

13. The flex-column of claim 2, wherein the at least one hole has a size sufficient to provide opportunity for a portion of another flex-column to interlock with the at least one hole.

14. The flex-column of claim 1, wherein the flex line is formed by one or more perforations having a selected shape, size and location of the flex-column to correspond to a desired resistance to flexing along the flex line.

15. The flex-column of claim 1, further comprising a point formed on each of the three corners proximate to at least one of the open first end or the open second end.

16. A flex-column comprising:

a multi-sided column having at least three sides, an open first end, an open second end, and at least three corners, each one of the at least three sides including:

a flex line dividing each of the at least three sides into two portions, the flex line allowing the two portions to flex along the flex line to form first fold angle between the two portions;

at least one perforation along an edge of each one of the two portions wherein the edge of each one of the two portions coincides with one of the at least three corners; and at least one non-perforation along an edge of each one of the two portions, wherein the at least one non-perforation along an edge of each one of the two portions coincides with an intersection of the flex line and at least one of the at least three corners, wherein each one of the at least three sides has a thickness corresponding to a desired flex characteristic, wherein the at least one non-perforated portion along an edge of each one of the two portions has a length corresponding to a desired flex characteristic, wherein the at least one perforated portion along an edge of each one of the two portions has a length corresponding to a desired flex characteristic.

17. The flex-column of claim 15, wherein the point formed on each of the three corners includes at least one edge extending the point away from the corresponding open first end or the open second end.

18. The flex-column of claim 17, wherein the edge extending the point away from the corresponding open first end or the open second end includes an irregular pattern.

19. The flex-column of claim 17, wherein the edge extending the point away from the corresponding open first end or the open second end includes a stair step pattern.

20. The flex-column of claim 1, wherein at least one of the three corners includes a plurality of scallops.

* * * * *